United States Patent [19]

Gantenbrink

[11] 4,368,508

[45] Jan. 11, 1983

[54] LIGHT FOR SUBMERSIBLE PRESSURE VESSEL WITH COOLING MEANS

[76] Inventor: Rudolf Gantenbrink, Am Tiergarten 58, 3000 Hannover 73, Fed. Rep. of Germany

[21] Appl. No.: 209,287

[22] Filed: Nov. 21, 1980

[30] Foreign Application Priority Data

Nov. 28, 1979 [DE] Fed. Rep. of Germany ..... 2947817

[51] Int. Cl.[3] ..... F21V 29/00

[52] U.S. Cl. ..... 362/267; 362/227; 362/294; 362/373

[58] Field of Search ..... 362/267, 373, 227, 294

[56] References Cited

U.S. PATENT DOCUMENTS 3,331,959 7/1967 Sayre ..... 362/267
3,566,100 2/1971 Seeley ..... 362/267
3,840,734 10/1974 Oram ..... 362/267
4,219,871 8/1980 Larrimore ..... 362/267

*Primary Examiner*—Donald P. Walsh
*Attorney, Agent, or Firm*—Michael J. Striker

[57] ABSTRACT

A light for a submersible pressure vessel is partially mounted within the interior of the pressure vessel and has a metallic element mounted in a wall of the vessel and extended outside the pressure vessel from this wall. The light further includes a container sealingly closed by the metallic element. The container is composed of two translucent bulbs spaced from one another to define a cavity filled with water. A light element such as a lamp is inserted into the inner bulb and extends outside the pressure vessel so that its electrical cable is positioned outside the vessel. A cooling member is connected to the metallic element to remove heat generated by the lamp and transmitted through water and the metallic element.

23 Claims, 2 Drawing Figures

LIGHT FOR SUBMERSIBLE PRESSURE VESSEL WITH COOLING MEANS

BACKGROUND OF THE INVENTION

The present invention pertains to submersible pressure vessels and more particularly to lights utilized within the interior of the pressure vessel.

Lights used in submersible pressure vessels are commonly known. The lights for pressure vessels have various requirements. The light must produce the least possible dead angle and at the same time must be sufficiently bright for illuminating the whole pressure vessel. For safety purposes, the lamps used for the lights in submersible pressure vessels must have a surface temperature which does not exceed 60° C.

The known lights for pressure vessels normally include filament lamps, which are covered with containers filled with a heat-conducting fluid. The fluid contained in such containers, usually water, is arranged in connection with an element having good heat conductivity. This element is usually a wall of the pressure vessel. In this case, heat produced by the filament lamp must be conducted to this wall.

It has been recognized that in such installations, only filament lamps having a power of 20 watts may be used in order to keep the maximum surface temperature within a limit of 60° C. However, the illuminating of the pressure vessel with such lamps is not possible since the available candle power is not sufficient.

Lamps must be installed in the interior of the pressure vessel; however electrical cables must extend out from the pressure vessel. Since submersible pressure vessels often operate at a great depth and employ a helium-air environment, the cables must be reliably sealed against helium. Due to the small size of helium molecules even under normal pressure helium can enter inside the cables. During the decomposition of the pressure vessel the infiltrated helium then can not quickly enough escape from the cables so that a high over pressure may build up within the cables. This can lead to the formation of bubbles in the cables and eventually to damage to the cables.

A further disadvantage of known light installations is that the use of voltage in excess of 50 V is not allowed by regulations. Low voltage lamps must therefore be utilized for illuminating submersible pressure vessels. Such lamps, however, have a lower life-span than the commonly used 220 V lamps. Another disadvantage of the known installations resides in that because of insufficient power of these lamps a number of lamps must be installed in the pressure vessel. This leads to substantial restriction of the volume of the pressure vessel, which volume must be sufficient for movement of a person occupying the pressure vessel.

In order to avoid difficulties encountered in the prior art devices, it has been suggested to use a porthole in the pressure vessel. Light then enters the pressure vessel from lamps mounted outside the pressure vessel. In such installation, the illuminating of the pressure vessel is not sufficiently good. Even if a number of such portholes are provided there are still areas in the pressure vessel which can be not sufficiently illuminated since the number of port-holes has to stay within reason. (It must not be so large as to weaken the structural strength of the vessel wall).

SUMMARY OF THE INVENTION

It is an object of the invention to provide a light for a submersible pressure vessel, which light avoids by simple means the aforementioned shortcomings encountered in the prior art.

Another object of the invention is to provide an improved light which provides for sufficient illumination of the pressure vessel and has a sufficient light power and a restrained maximum surface temperature of the lamp.

These and other objects of the invention are obtained by a light for a submersible pressure vessel having an interior surrounded by a wall, the light comprising a heat-conducting element inserted in an opening of said wall and extending outside the pressure vessel from said wall, a container sealingly closing said element from the interior of the pressure vessel, said container being filled with heat-containing fluid, a light element positioned in said container, and cooling means connected to said element.

The container may include a first bulb spaced from said light element and having a first portion sealingly connected to said heat-conducting element and second portion extending into said interior.

The first bulb may be made off translucent material. The container may further include a second bulb peripherally surrounding said light element. The second bulb may also be made of translucent material.

The first bulb may be spaced from said second bulb to define a cavity therebetween, said cavity being filled with said heat-conducting fluid.

The heat-conducting element may be a part of said container, said part extending outside the pressure vessel.

The light element may be insertable into said container from outside the pressure vessel.

The light may further comprise a protective bulb arranged to peripherally close said second portion of said first bulb. The protective bulb may be translucent and made of synthetic material.

The cooling means may include a cooling member having a relatively larger outer surface, said cooling member being located outside the pressure vessel.

The cooling member may be formed with a plurality of ribs located on the outer surface thereof.

The cooling means may further include a ventilator, which is mounted on the cooling member.

The heat-conducting element may be formed with a capillary channel extending from said first portion of said first bulb towards said wall, said channel being in communication with the exterior of the pressure vessel.

The heat-conducting element may be metallic.

The light may further include a pair of O-ring seals located between said first portion of said first bulb and said metallic element, said seals being spaced from one another so that said capillary channel is located therebetween. Said metallic element may be formed with a flange located outside the pressure vessel, said flange covering said container from outside the pressure vessel.

The metallic element may be provided with a flange portion located in the interior of the pressure vessel. This flange portion may be rigidly connected to the protective bulb.

The light may further comprise volume compensating means in form of a plunger inserted in an opening formed in said metallic element, said plunger being in communication with said cavity.

The plunger may be movable towards and from said cavity to change the pressure of heat-conducting fluid in said cavity.

The volume compensating means may instead comprise an elastically deformable element containing a compressible volume of gas.

The fluid in the cavity may be water.

In the light of the invention all the disadvantages of the prior art may be avoided. The light provides the optimum illumination of the interior of the pressure vessel. The electrical connection of the light is guided to the outside of the vessel. Heat generated by the light is transmitted to the outside of the vessel. In such installation, it is possible to use lamps of 150 watt without thereby reaching the maximum surface temperature of 60° C.

The light element and the light itself project into the pressure vessel very slightly, and the illuminating in the vessel occurs without dead angle. Almost the entire volume of space within the pressure vessel is thus available for a person or persons occupying the vessel.

Lamps of 220 V may be used for light elements inserted into the bulbs which prolongs the life-span of the lights.

The insertion of the light element in the bulb and extension of this element outside the pressure vessel makes the change of the light element very easy without requiring the change of the whole light. Therefore the change of the light elements is possible even during operation of the pressure vessel.

The provision of the light with cooling means is very important. The removing of heat from the light is particularly important in operation under water. During operation above the level of water, or in the air environment it is expedient to install a ventilator on the cooling element in order to further remove heat from the light.

As known from the prior art, in pressure vessels operated in a helium-oxygen environment the standard seals are not sufficient to prevent helium from collecting in the vessel. Helium may penetrate into closed spaces associated with the vessel, and under conditions of decompression of the vessel which results in occurrence of the overpressure in said spaces, an explosion may occur in these spaces. This applies to the spaces in the light. However, the capillary channel located between the seals of the invention overcomes this problem encountered in known devices.

The device of the invention permits one to avoid the danger caused by temperature fluctuations in the container filled with water. This is achieved by a plunger adapted to change the pressure of water in the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
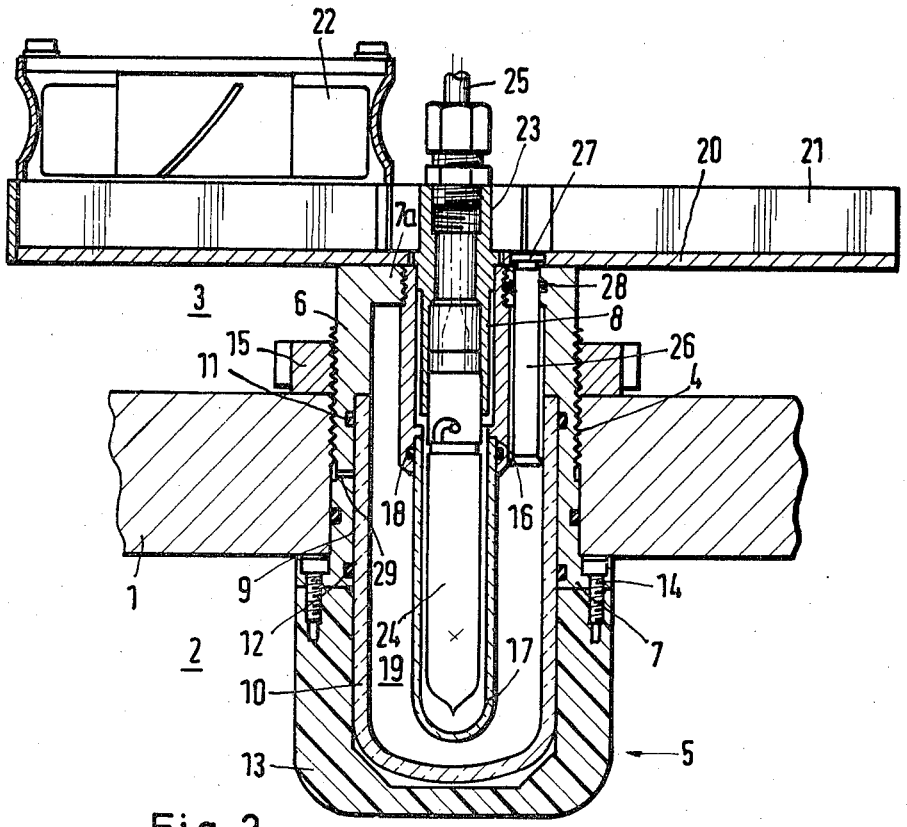
FIG. 1 is a sectional view through a light of the invention.

Referring to the drawings, and first to FIG. 1, it may be seen that a light 5 is inserted into an opening 4 formed in a wall 1 of a submersible pressure vessel not otherwise illustrated herein. Reference numeral 2 designates the interior of the pressure vessel whereas reference numeral 3 denotes the exterior or outside thereof.

The light or the lamp 5 includes a substantially cylindrical hollow metallic member 6 which is mounted in the opening 4 and extends to the exterior 3 of the pressure vessel. The member 6 is provided with a flange 7 having a surface abutting against the wall 1. The metallic member 6 is formed with a flange portion **7*a* which constitutes an opening to receive a hollow cylindrical element 6*a*. A sleeve 8 is rigidly secured within the element 6*a* which in turn is rigidly mounted in the member 6. The sleeve 8 projects into the interior of the metallic member 6**.

The cylindrical member 6 is provided with an inner recess 9 formed at the level of the wall 1. A glass bulb 10 is mounted in the recess 9 and projects towards the interior 2 of the pressure vessel. A pair of circular O-ring seals 11 and 12 are placed between the glass bulb 10 and the metallic member 6. A bulb 13 made of acrylic glass peripherally surrounds the inner part of the bulb 10 and is connected to the flange 7 of member 6 by screws 14. The bulb 13 serves as a protecting element for the glass bulb 10.

The peripheral outer surface of the metallic member 6 is provided with an outer thread 40 by which a fastening ring 15 is threaded to the member 6 to support the latter on the wall 1. The element **6*a* is formed with a recess 16 at a free end thereof which serves to hold a second glass bulb 17 extending into the interior of the bulb 10. The bulb 10 is sealed against the metallic element 6*a* by a O-ring seal 18. A hollow space 19 is defined between the outer surface of the bulb 17, the inner surface of the bulb 10 and the inner wall of the flange portion 7*a*. This space serves as a container for a fluid to be used in the lamp 5**. This fluid may be water.

Figure 2:
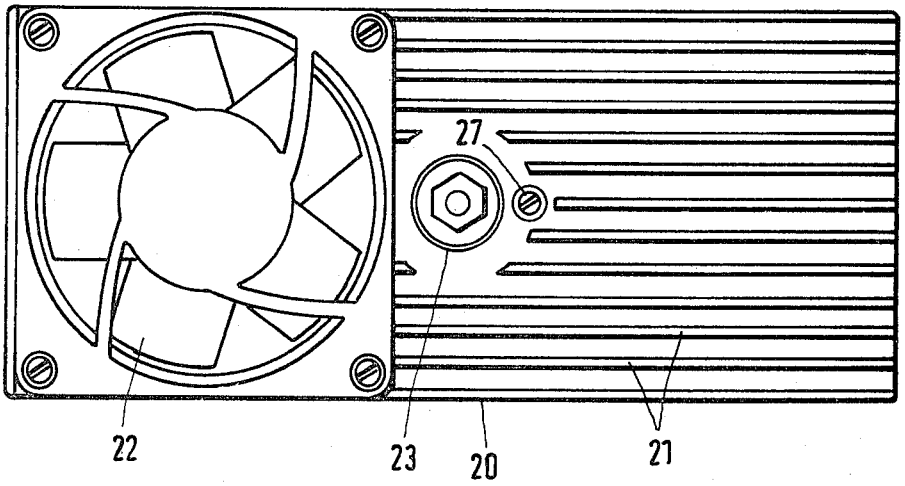
FIG. 2 is a top plan view of FIG. 1.

The flange portion **7*a* of the metallic member 6 flatly abuts against a relatively large cooling element 20. This cooling element has a number or ribs 21 formed at the surface thereof as clearly seen in FIG. 2. Ribs 21 are provided to enlarge the outer surface of the cooling element to increase its heat conductivity. In order to further increase the heat conductivity of the cooling element a ventilator 22 is mounted adjacent the ribs 21. The ventilator 22** is used to draw cooling air around the cooling element when the pressure vessel operates above water level.

The cooling element has an opening 23 which receives the sleeve 8 and is aligned therewith. An elongated light element 24 is inserted into the sleeve 8 and is further extended into the bulb 17. The electrical connection of the light element 24 with an outside source is obtained by a cable 25 which projects outside the pressure vessel through the sleeve 8.

As was mentioned above, the space 19 is filled with water. In order to reduce the pressure exerted by the water in the space 19 a plunger 26 is mounted in an elongated opening formed in the member 6, which plunger is movably supported within said opening so that the plunger can yield when over-pressure occurs in the space 19. The plunger 27 is adapted to extend into a recess **27*a* formed in the cooling element 20**.

In order to seal the space 19 with respect to the exterior 3 of the pressure vessel the portion of the light element which projects into the bulb 17 is completely covered by this bulb.

In operation, water in the space 19 transmits heat received from the light element 24 to the metallic member 6 and then to the cooling element 20 positioned outside the pressure vessel so that the light of the light element 24 can enter the interior of the pressure vessel practically without hindrance but the heat generated by the light element 24 is transmitted to the outside of the vessel.

The electrical connection of the light element 24 is located completely outside the pressure vessel. This connection is separated from the interior of the vessel by the sleeve 8 and the second glass bulb 17 so that this connection never comes in contact with the interior of the pressure vessel.

A capillary 29 is provided in the member 6 between the seals 11 and 12, which capillary serves to permit helium eventually collected in the light under overpressure to escape outside the pressure vessel. By means of this capillary helium is guided to the exterior 3 of the vessel so that the penetration of even small amounts of helium into the lamp 5, particularly into the space 19, is prevented.

It will be understood that each of the elements described above, or two or more together, may also find a useful application in other types of a light differing from the types described above.

While the invention has been illustrated and described as embodied in a light, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A light for a submersible pressure vessel having an interior surrounded by a wall, the light comprising a heat-conducting element inserted in an opening of said wall and extending outside the pressure vessel from said wall; a container sealingly closing said element from the interior of the pressure vessel; a light element positioned in said container and having an electrical connection extended outside the pressure vessel, said container including a first bulb and a second bulb peripherally surrounding said light element, said first bulb being spaced from said second bulb to define a cavity therebetween, said cavity being filled with heat-conducting fluid, said heat-conducting fluid being in contact with said heat-conducting element; and cooling means connected to said heat-conducting element, whereby the light is adapted to illuminate the interior of the pressure vessel and dissipate heat at the exterior thereof.

2. The light of claim 1, wherein said first bulb includes a first portion sealingly connected to said heat-conducting element and a second portion extending into said interior.

3. The light of claim 2, wherein said first bulb is made of translucent material.

4. The light of claim 3, wherein said second bulb is made of translucent material.

5. The light of claim 4, wherein said heat-conducting element is a part of said container, said part extending outside the pressure vessel.

6. The light of claim 5, wherein said light element is insertable into said container from outside the pressure vessel.

7. The light of claim 6, further comprising a protective bulb arranged to peripherally close said second portion of said first bulb.

8. The light of claim 7, wherein said protective bulb is translucent.

9. The light of claim 8, wherein said protective bulb is made of synthetic material.

10. The light of claim 9, wherein said cooling means include a cooling member with a relatively large outer surface, said cooling member being located outside the pressure vessel.

11. The light of claim 10, wherein said cooling member is formed with a plurality of ribs located on said outer surface thereof.

12. The light of claim 11, wherein said cooling means further include a ventilator.

13. The light of claim 12, wherein said ventilator is mounted on said cooling member.

14. The light of claim 13, wherein said heat-conducting element is formed with a capillary channel extending from said first portion of said first bulb towards said wall, said channel being in communication with the outside of the pressure vessel.

15. The light of claim 14, wherein said heat-conducting element is metallic.

16. The light of claim 15, further including a pair of O-ring seals located between said first portion of said first bulb and said metallic element, said seals being spaced from one another so that said capillary channel is located therebetween.

17. The light of claim 16, wherein said metallic element is formed with a flange located outside the pressure vessel, said flange covering said container from outside the pressure vessel.

18. The light of claim 17, wherein said metallic element is provided with a flange portion located in the interior of the pressure vessel.

19. The light of claim 18, wherein said flange portion is rigidly connected to said protective bulb.

20. The light of claim 19, further comprising volume-compensating means in an opening formed in said metallic element, said compensating means being in communication with said cavity.

21. The light of claim 20, wherein said means include a plunger movable relative to said cavity to prevent the build-up of explosive overpressure in the heat-conducting fluid in said cavity.

22. The light of claim 20, wherein said means comprise an elastically deformable element containing a compressible volume of gas.

23. The light of claim 22, wherein said fluid is water.

* * * * *